US007434619B2

(12) United States Patent
Rossi et al.

(10) Patent No.: US 7,434,619 B2
(45) Date of Patent: Oct. 14, 2008

(54) OPTIMIZATION OF RESERVOIR, WELL AND SURFACE NETWORK SYSTEMS

(75) Inventors: David J. Rossi, Katy, TX (US); James J. Flynn, Houston, TX (US)

(73) Assignee: Schlumberger Technology Corporation, Houston, TX (US)

( * ) Notice: Subject to any disclaimer, the term of this patent is extended or adjusted under 35 U.S.C. 154(b) by 161 days.

(21) Appl. No.: 10/467,275

(22) PCT Filed: Feb. 4, 2002

(86) PCT No.: PCT/US02/03224

§ 371 (c)(1),
(2), (4) Date: Jan. 20, 2004

(87) PCT Pub. No.: WO02/063130

PCT Pub. Date: Aug. 15, 2002

(65) Prior Publication Data

US 2004/0104027 A1 Jun. 3, 2004

(51) Int. Cl.
*E21B 43/12* (2006.01)

(52) U.S. Cl. ..... 166/250.15; 166/53; 166/250.01

(58) Field of Classification Search ..... 166/250.15, 166/53, 250.01, 20.015
See application file for complete search history.

(56) References Cited

U.S. PATENT DOCUMENTS 4,633,954 A 1/1987 Dixon et al.
4,796,699 A 1/1989 Upchurch
4,856,595 A 8/1989 Upchurch
4,896,722 A 1/1990 Upchurch
4,915,168 A 4/1990 Upchurch
5,597,042 A 1/1997 Tubel et al.
5,732,776 A 3/1998 Tubel et al.
5,881,811 A 3/1999 Lessie et al.
5,975,204 A 11/1999 Tubel et al.

(Continued)

OTHER PUBLICATIONS

Beamer, Alan, et al."From Pore to Pipeline, Field-Scale Solutions", Oilfield Review pp. 2-19, Summer 1998.

(Continued)

*Primary Examiner*—Giovanna C Wright
(74) *Attorney, Agent, or Firm*—Osha•Liang LLP

(57) ABSTRACT

A method and associated apparatus continuously optimizes reservoir, well and surface network systems by using monitoring data and downhole control devices to continuously change the position of a downhole intelligent control valve (ICV) (12) until a set of characteristics associated with the "actual" monitored data is approximately equal to, or is not significantly different than, a set of characteristics associated with "target" data that is provided by a reservoir simulator (32). A control pulse (18) having a predetermined signature is transmitted downhole thereby changing a position of the ICV. In response, a sensor (14) generates signals representing, "actual" monitoring data. A simulator (32) which models a reservoir layer provides "target" data. A computer apparatus (30) receives the "actual" data and the "target" data and, when the "actual" data is not approximately equal to the "target" data the computer apparatus (30) executes a "monitoring and control process" program code which changes the predetermined signature of the control pulse to a second and different predetermined signature. A new pulse having the second predetermined signature is transmitted downhole and the above process repeat until the "actual" data received by the computer apparatus (30) is approximately equal to the "target" data.

2 Claims, 17 Drawing Sheets

U.S. PATENT DOCUMENTS

| | | | | |
|---|---|---|---|---|
| 5,992,519 | A | 11/1999 | Ramakrishnan et al. | |
| 6,046,685 | A | 4/2000 | Tubel | |
| 6,101,447 | A | 8/2000 | Poe, Jr. | |
| 6,236,894 | B1 | 5/2001 | Stoisits et al. | |
| 6,266,619 | B1 | 7/2001 | Thomas et al. | |
| 6,356,844 | B2 | 3/2002 | Thomas et al. | |
| 6,434,435 | B1 * | 8/2002 | Tubel et al. | 700/30 |
| 2002/0049575 | A1 * | 4/2002 | Jalali et al. | 703/10 |
| 2002/0106316 | A1 | 8/2002 | Billg et al. | |
| 2002/0165671 | A1 | 11/2002 | Middya | |
| 2002/0177955 | A1 | 11/2002 | Jalali et al. | |

OTHER PUBLICATIONS

Beliakova, N., et al. "Hydrocarbon Field Planning Tool . . . forecasting from oil and gas fields using integrated subsurface-surface models", SPE 65160, pp. 1-5, 2000.

Hepguler G. Gokhan, et al., "Applications of a field Surface Network Simulator Integrated With a Reservoir Simulator", SPE 38007, pp. 285, 286,1997.

Hepguler, Gokhan, et al., "Integration of a Field Surface and Production Network With a Reservoir Simulator", SPE Computer Applications, pp. 88-93, Jun. 1997.

Hoist, Richard, et al., "Computer Optimization of Large Gas Reservoirs with Complex Gathering Systems", SPE 56548, pp. 1-8, 1999.

Lamey, M.F., et al., "Dynamic Simulation of the Europa and Mars Expansion Projects: . . . Subsea and Topsides Modeling", SPE 56704, pp. 1-9, 1999.

Liu, Wei, et al., "Optimal Control of Steamflooding", SPE Advanced Technology Series, vol. 1 No. 2, pp. 73-82.

Lo, K.K., et al., "Application of Linear Programming to Reservoir Development Evaluations", SPE Reservoir Engineering, pp. 52-58, Feb. 1995.

Lyons, S.L., et al., "Integrated Management of Multiple-Reservoir Field Development", JPT, pp. 1075-1081, Dec. 1995.

Palke, Miles R., et al., "Nonlinear Optimization of Well Production Considering Gas Lift and Phase Behavior", SPE, pp. 341-356, 1997.

Tingas, John, et al., "Integrated Reservoir and Surface Network Simulation in Reservoir Management of Southern North Sea Gas Reservoirs", SPE 50635, pp. 51-62, 1998.

Tirck, M.D., "a Different Approach to Coupling a Reservoir Simulator with a Surface Facilities Model", SPE 40001, pp. 285-290, 1998.

Venkataraman, Ramachandran, et al., Application of PIPESIM-FPT Link to Eclipse 100 to Evaluate Field Development Options, OTC 11966, pp. 1-9,2000.

Weisenborn, A. J. (Toon), et al., "Compositional integrated subsurface-surface modeling", SPE 65158, pp. 1-12, 2000.

Wade,K. et al,Examining the role of computer modelling in the planning & development of oil & gas fields,Baker Jardine & Assoc. ,Advance in Pipeline Tech.,Sep. 15-16, 1997, Dubai,UAE.

Wade, K. et al., Optimisation of Multiphase Oil & Gas Production pipeline networks, Baker Jardine & Assoc., Applications for Multiphase Tech., Dec. 15-16, 1997, Dubai, UAE.

Wade, K. et al., Avaliable Technology in Field Planning & Field Production Optimisation, Baker Jardine & Assoc.,The 1998 Gas Processing Symposium, May 10-12, 1998, Dubai, UAE.

Wade, K. et al., Applying New Technology for Field Planning & Production Optimisation, Baker Jardine & Assoc.,The 1999 Gas Processing Symposium, Apr. 26-28, 1999, Dubai, UAE.

Zakirov, I. et al., Optimizing Reservoir Performance by Automatic Allocation of Well Rates, ECMOR V., Sep. 3-5, 1996, pp. 375-384, Leoben, Austria.

Algeroy, J. et al., Controlling Reservoirs from Afar, Oilfield Review, Autumn 1999, pp. 18-29.

Baker, A. et al., Permanent Monitoring- Looking at Lifetime Reservoir Dynamics, Oilfield Review, Winter 1995, pp. 32-46.

Nikravesh, M. et al., Nonlinear Control of an Oil Well, Proceedings of the American Control Conference, Jun. 1997, pp. 739-743, Albuquerque, New Mexico.

Zhuang, X. et al., Parallelizing a Reservoir Simulator Using MPI, IEEE, 1995, pp. 165-174.

Heinemann, R. F. et al., Next generation reservoir optimization, World Oil, Jan. 1998, pp. 47-54, vol. 219 No. 1.

The Seismograph Service Companies, Frelani, Users' Manual—Phoenix System, pp. 167-170.

Earth Technology Consultants Inc., Plot and Output TI Tape Amplitude and Phase Spectrum, SPECAN 1, ADSEIS, Sep. 19, 1987.

* cited by examiner

FIG. 17
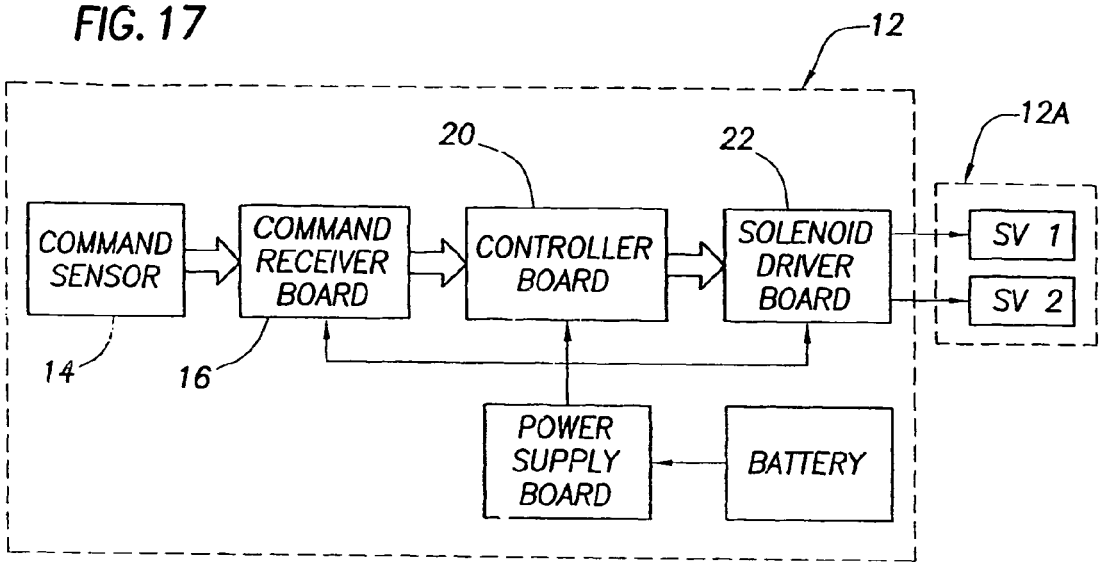
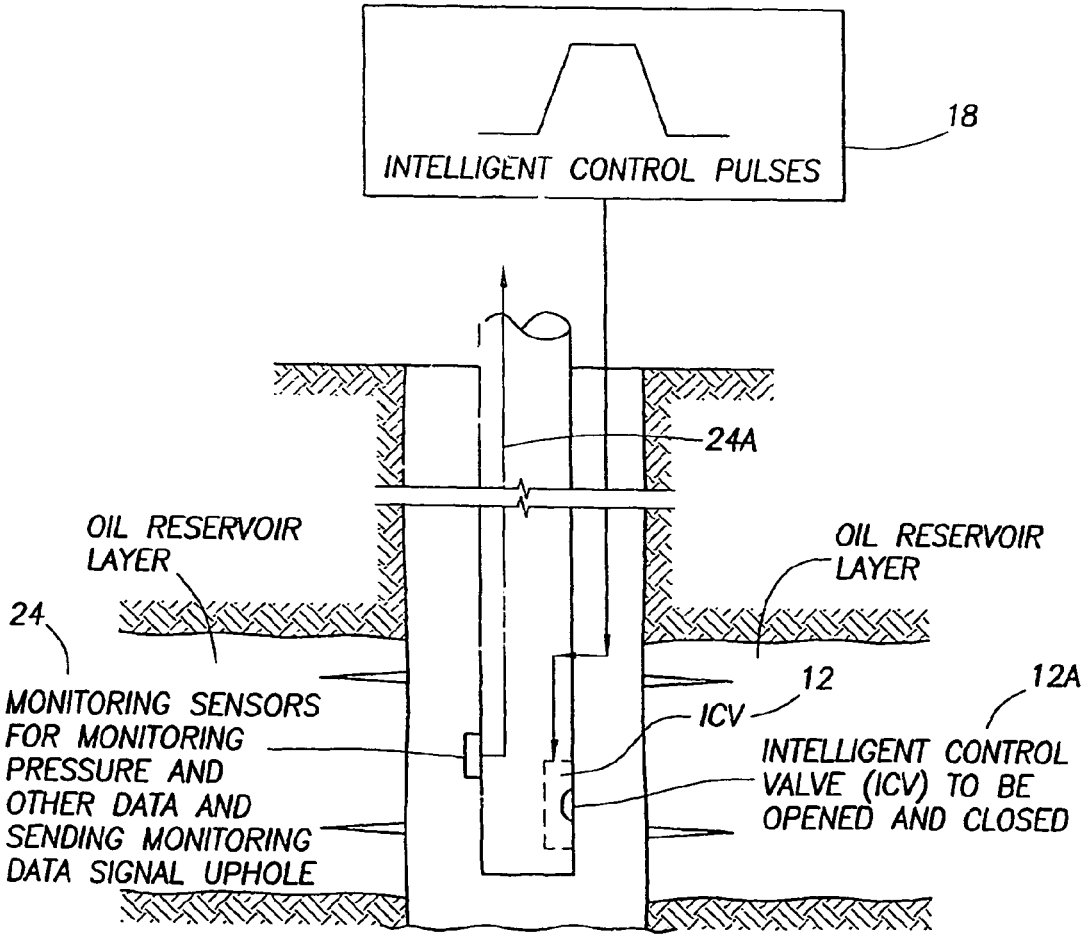
FIG. 18

OPTIMIZATION OF RESERVOIR, WELL AND SURFACE NETWORK SYSTEMS

BACKGROUND OF THE INVENTION

The subject matter of the present invention relates to a process, which can be implemented and practiced in a computer apparatus, for transforming monitoring data, which can include real time or non-real time monitoring data, into decisions related to optimizing an oil and/or gas reservoir, usually by opening or closing downhole intelligent control values.

In the oil and gas industry, intelligent control valves are installed downhole in wellbores in order to control the rate of fluid flow into or out of individual reservoir units. Downhole intelligent control valves (ICVs) are described in, for example, the Algeroy reference which is identified as reference (1) below. Various types of monitoring measurement equipment are also frequently installed downhole in wellbores, such as pressure gauges and multiphase flowmeters; refer to the Baker reference and the Beamer reference which are identified, respectively, as references (2) and (3) below. This specification discloses a process for transforming monitoring data (either real-time or non-real-time monitoring data) into decisions related to optimizing an oil or gas reservoir, usually by opening or closing a set of downhole intelligent control valves (ICV) in the oil or gas reservoir.

SUMMARY OF THE INVENTION

Accordingly, a novel 'monitoring and control' process is practiced in a monitoring and control apparatus that is located both uphole in a computer apparatus that is situated at the surface of a wellbore and downhole in a computer apparatus situated inside the wellbore. That portion of the monitoring and control apparatus that is situated uphole (hereinafter, the 'uphole portion of the monitoring and control apparatus') is responsive to a plurality of monitoring data, where the monitoring data is received from that portion of the monitoring and control apparatus that is situated downhole (hereinafter, the 'downhole portion of the monitoring and control apparatus'). The 'downhole portion of the monitoring and control apparatus' is actually comprised of a 'well testing system' that is situated downhole in a wellbore. The 'uphole portion of the monitoring and control apparatus' functions to selectively change a position of an intelligent control valve that is disposed within the 'downhole portion of the monitoring and control apparatus', the position of the intelligent control valve in the downhole apparatus being changed between an open and a closed position in order to maintain an 'actual' cumulative volume of water that is produced from a reservoir layer in the wellbore (or injected into a reservoir layer) to be approximately equal to a 'target' cumulative volume of water (i.e., the 'target value') which is desired to be produced from the reservoir layer in the wellbore (or injected into the reservoir layer).

A simulation program, embodied in a separate workstation computer, models the reservoir layer and predicts the 'target' cumulative volume of water (or reservoir fluid) that will be produced from the reservoir layer (or will be injected into the reservoir layer). The open and closed position of the Intelligent Control Valve (ICV) in the 'downhole portion of the monitoring and control apparatus' must be changed in a particular manner and in a particular way and at a particular rate in order to ensure that the 'actual' cumulative volume of water (or other reservoir fluid) that is produced from the reservoir layer (or is injected into the reservoir layer) is approximately equal to the 'target' cumulative volume of water (or other reservoir fluid) that is predicted to be produced from the reservoir layer (or is predicted to be injected into the reservoir layer). It is the function of the 'uphole portion of the monitoring and control apparatus' to change the open and closed position of the ICV of the downhole apparatus in the particular manner and in the particular way and at the particular rate in order to ensure that the 'actual' cumulative volume of water (or other reservoir fluid) which is produced from the reservoir layer (or is injected into the reservoir layer) is approximately equal to the 'target' cumulative volume of water (or other reservoir fluid) that is predicted to be produced from the reservoir layer (or is predicted to be injected into the reservoir layer). If the position of the ICV of the downhole apparatus cannot be changed by the uphole apparatus in the particular manner and the particular way and at the particular rate in order to ensure that the 'actual' cumulative volume of water or fluid is approximately equal to the 'target' cumulative volume of water or fluid, then, the value of the 'target' cumulative volume of water or fluid that is predicted by the simulation program, which is embodied in the separate workstation computer, must be changed (hereinafter, the changed target cumulative volume of water or fluid). Then, once this change of the 'target' value has taken place, the above identified process is repeated; however, now, the 'target' cumulative volume of water or fluid is equal to the 'changed target' cumulative volume of water or fluid.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 15 through 17 illustrate an example of an intelligent control value (ICV) that can be disposed in a well testing system that is adapted to be disposed downhole in a wellbore; and FIGS. 18 and 19 illustrate a system including the monitoring and control process of the present invention adapted for changing the position of an intelligent control valve (ICV) in response to output signals received from one or more monitoring sensors and an execution of the monitoring and control process of the present invention.

DETAILED DESCRIPTION OF THE INVENTION

Referring initially to FIGS. 15 through 19, an example of a system including an intelligent control valve (ICV) disposed within a well testing system adapted to be disposed downhole in a wellbore is illustrated.

Figure 15:
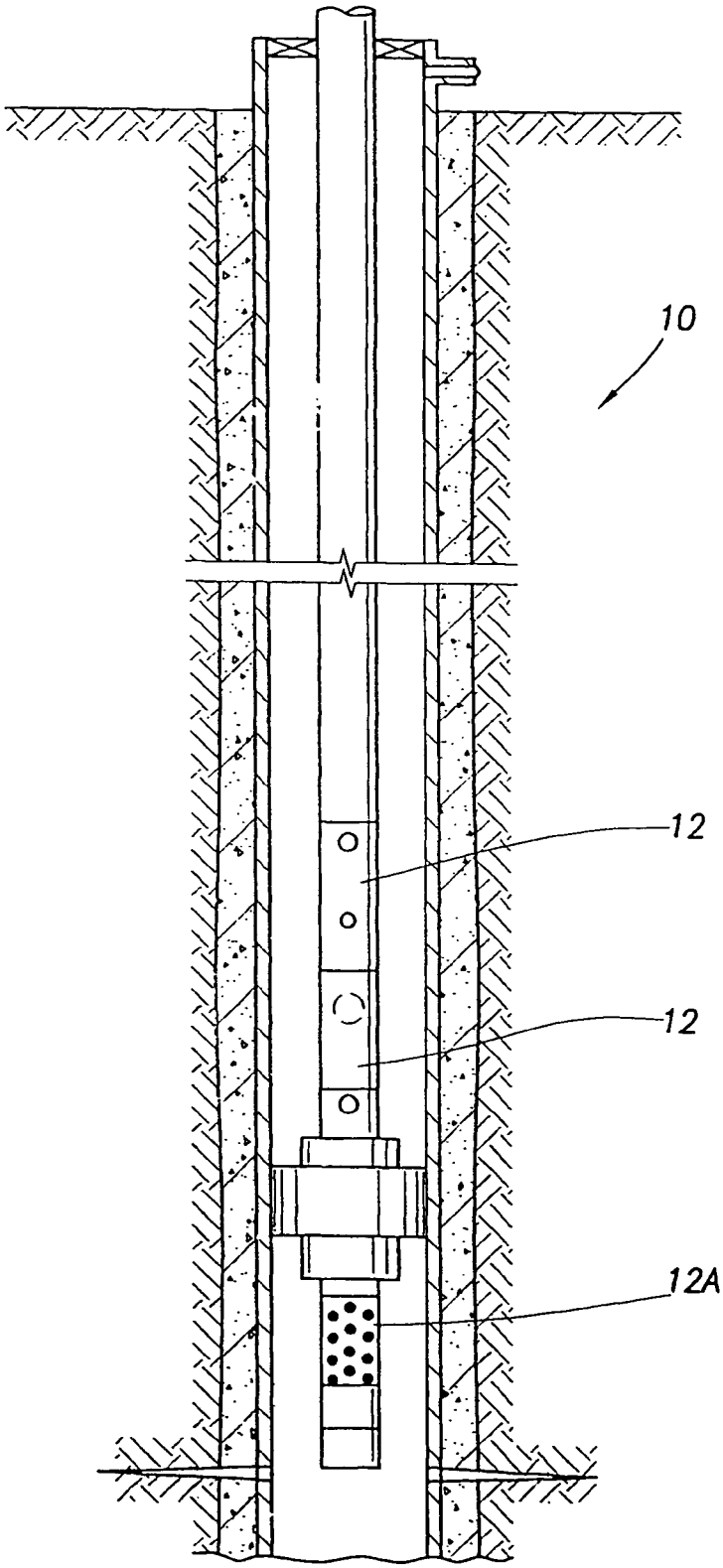

In FIG. 15, a well testing system 10 is illustrated. The well testing system 10 of FIG. 15 is discussed in U.S. Pat. Nos. 4,796,699; 4,915,168; 4,896,722; and 4,856,595 to Upchurch, the disclosures of which are incorporated by reference into this specification. The well testing system 10 includes an intelligent control valve (ICV) 12 that is operated in response to a plurality of intelligent control pulses 18 that are transmitted downhole from the surface.

Figure 16:
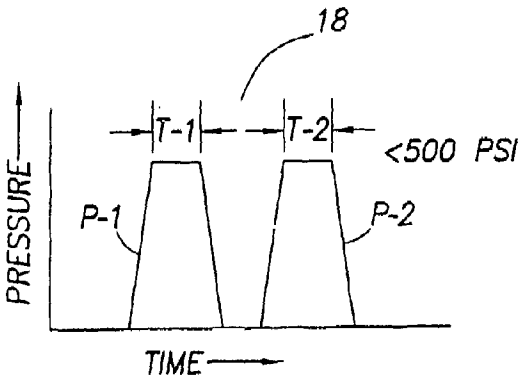

In FIG. 16, the plurality of control pulses 18 are illustrated in FIG. 16. Each pulse 18 or pair of pulses 18 have a unique 'signature' where the 'signature' consists of a predetermined pulse-width and/or a predetermined amplitude and/or a predetermined rise time that can be adjusted/changed thereby changing the 'signature' in order to operate the intelligent control valve 12 of FIG. 15.

In FIG. 17, the intelligent control valve 12 of FIG. 15 includes a command sensor 14 adapted for receiving the control pulses 18 of FIG. 16, and a command receiver board 16 receives the output from the command sensor 14 and generates signals which are readable by a controller board 20. The controller board 20 includes at least one microprocessor. That microprocessor stores a program code therein which can be executed by a processor of the microprocessor. One example of the program code is the program code disclosed in U.S. Pat. No. 4,896,722 to Upchurch, the disclosure of which is already incorporated herein by reference. In response to the control pulses 18 which have a 'predetermined signature' that are received by the command sensor 14, the microprocessor in the controller board 20 interprets/decodes that 'predetermined signature' (which includes the pulse width and/or amplitude and/or rise time of the control pulses 18) and, responsive thereto, the microprocessor in the controller board 20 searches its own memory for a 'particular program code' having a 'particular signature' that corresponds to or matches that 'predetermined signature' of the control pulses 18. When the 'particular signature' stored in the memory of the microprocessor is found, and it corresponds to that 'predetermined signature', the 'particular program code' which corresponds to that 'particular signature' is executed by the processor of the microprocessor. As a result of the execution of the 'particular program code' by the processor, the microprocessor disposed in the controller board 20 energizes the solenoid driver board 22 which, in turn, opens and closes a valve (SV1 and SV2) 12A of the intelligent control valve 12 of FIG. 15. This operation is adequately described in U.S. Pat. Nos. 4,796,699; 4,915,168; 4,896,722; and 4,856,595 to Upchurch, the disclosures of which have already been incorporated by reference into this specification.

In FIG. 18, a simple well testing system including an intelligent control valve (ICV) is illustrated. In FIG. 18, the control pulses 18 of FIG. 16, having a 'predetermined signature' are transmitted downhole to the intelligent control valve (ICV) 12. In response thereto, a valve 12A associated with the ICV 12 opens and/or closes in a 'predetermined manner' when a microprocessor in the controller board 20 (of FIG. 17) of the ICV 12 executes the 'particular program code' stored therein in the manner discussed above with reference to FIGS. 15, 16, and 17. A wellbore fluid flows within the tubing of the well testing system. After the wellbore fluid flows within the tubing, one or more monitoring sensors 24 begin to sense and monitor the pressure, flowrate, and other data of the wellbore fluid which is flowing within the tubing. The monitoring sensors 24 begin to transmit monitoring data signals 24A uphole.

In FIG. 18, the 'predetermined signature' of the control pulses 18 can be changed. If the 'predetermined signature' of the control pulses 18 is changed to 'another predetermined signature', and when said 'another predetermined signature' of a new set of control pulses 18 is transmitted downhole to the ICV 12, the valve 12A of the ICV 12 will now open and/or close in 'another predetermined manner' which is different than the previously described 'predetermined manner' associated with the aforementioned 'predetermined signature' of the control pulses 18. Every time the 'predetermined signature' of the control pulses 1I is changed and transmitted downhole, the valve 12A of the ICV 12 can open and/or close in a different 'predetermined manner' and, as a result, the pressure and the flowrate of the wellbore fluid flowing within the tubing of FIG. 18 will change accordingly and, as a result, the monitoring sensors 24 will sense that changed pressure and flowrate of the wellbore fluid flowing in the tubing and will generate an output signal representative of that changed pressure and flowrate which is transmitted uphole. By way of example, refer to the U.S. Pat. No. 4,896,722 to Upchurch which has already been incorporated by reference into this specification.

Figure 19:
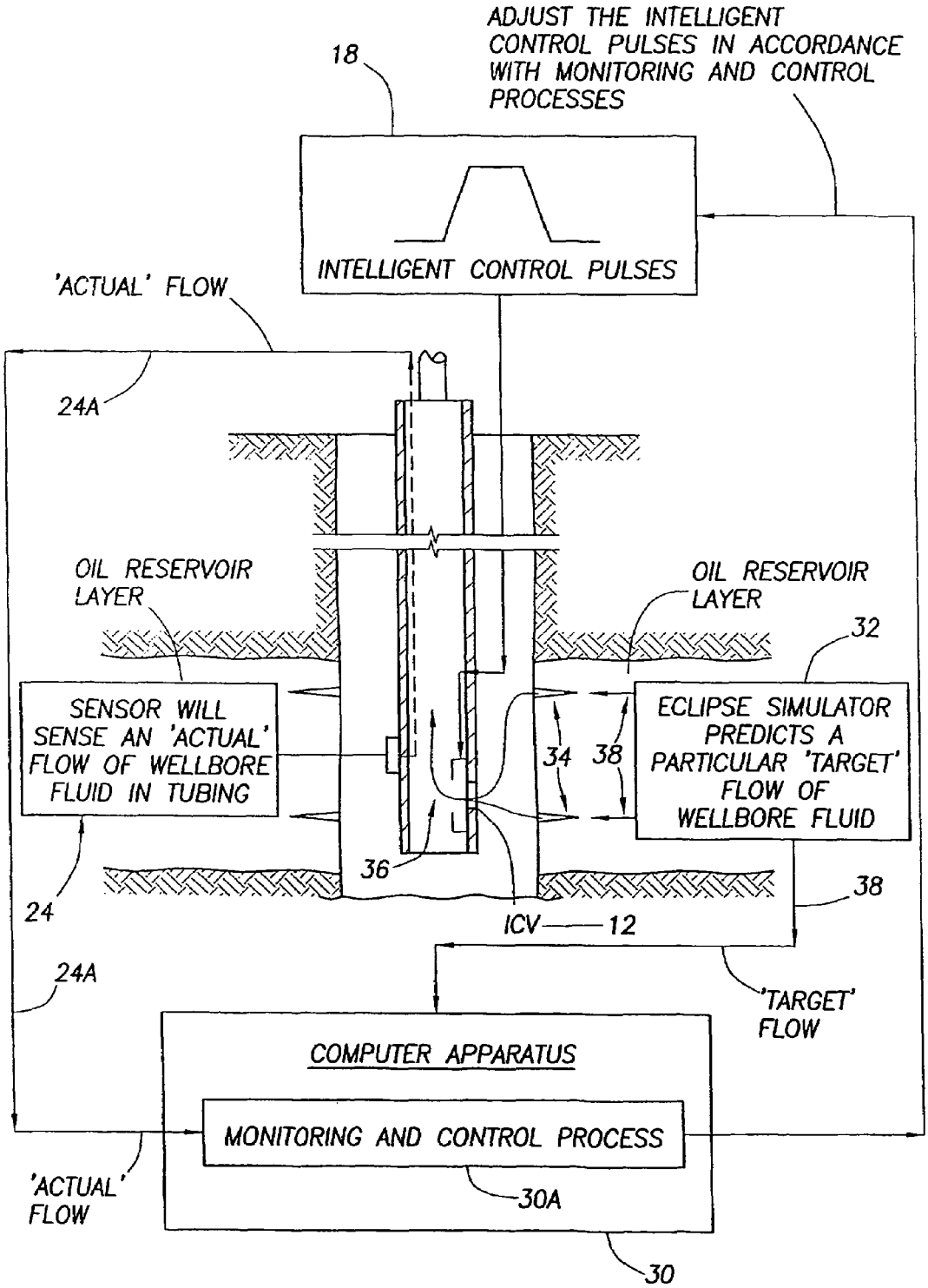

In FIG. 19, the simple well testing system including the intelligent control valve (ICV) 12 of FIG. 18 is illustrated; however, in FIG. 19, a computer apparatus 30, adapted to be located at a surface of the wellbore and storing a 'monitoring and control process' program code 30A stored therein, is illustrated. In addition, in FIG. 19, a simulator, known as the 'Eclipse simulator' 32, adapted for modeling and simulating the characteristics of the oil reservoir layer, is also illustrated: In FIG. 19, when the monitoring sensors 24 transmit their output signals 24A uphole, representative of the pressure and/or flowrate and/or other data of the wellbore fluid flowing within the tubing of the well testing system of FIG. 19, those output signals 24A will be received by the computer apparatus 30 which is located at the surface of the wellbore. The computer apparatus 30 stores therein a program code known as the 'monitoring and control process' 30A, in accordance with one aspect of the present invention. The output signals 24A, which are generated by the monitoring sensors 24, will hereinafter be referred to as the 'Actual' signals, such as the 'Actual flowrate' or the 'Actual pressure', etc, since the output signals 24A sense the 'Actual' flowrate and/or the 'Actual' pressure of the wellbore fluid flowing within the tubing of the well testing system of FIG. 19. When the computer apparatus 30 executes the monitoring and control process 30A in response to the 'Actual' signals 24A, the computer apparatus 30 generates an output signal which ultimately changes the 'signature' of the intelligent control pulses 18 of FIG. 19. In the meantime, in FIG. 19, an 'Eclipse simulator' 32 models and simulates the characteristics of the oil reservoir layer of FIG. 19, and, as a result, the 'Eclipse simulator' 32 predicts the flowrate and/or the pressure and/or other data associated with the wellbore fluid which is being produced from the perforations 34 in FIG. 19, as indicated by element numeral 36 in FIG. 19. The 'Eclipse simulator' can be licensed from, and is otherwise available from, Schlumberger Technology Corporation, doing business through the Schlumberger Information Solutions division, of Houston, Tex. The arrows 38 being generated by the 'Eclipse simulator' 32 of FIG. 19 represent the flowrate and/or the pressure and/or other data associated with the wellbore fluid which the 'Eclipse simulator' 32 predicts will be produced from the perforations 34 in FIG. 19. As a result, the arrows 38 being generated by the 'Eclipse simulator' 32 of FIG. 19 represent 'Target' signals 38, such as a 'Target' flowrate 38 and/or a 'Target' pressure 38 and/or a 'Target' other data 38 associated with the wellbore fluid which the 'Eclipse simulator' 32 predicts will be produced from the perforations 34 in FIG. 19.

In operation, referring to FIGS. 17, 18, and 19, the intelligent control pulses 18, having a 'predetermined signature' are transmitted downhole and the pulses 18 are received by the intelligent control valve (ICV) 12. That 'predetermined signature' of the pulses 18 are received by the command sensor 14 and, ultimately, by the controller board 20. The 'predetermined signature' is located in the memory of the microprocessor in the controller board 20, a 'particular program code' corresponding to that 'predetermined signature' and stored in the memory of the microprocessor is executed, and, as a result, the valve 12A of the ICV 12 is opened and/or closed in a 'predetermined manner' in accordance with the execution of the 'particular program code'. Wellbore fluid, having a flowrate and pressure and other characteristic data, now flows within the tubing of the well testing system of FIG. 19. The monitoring sensors 24 will now sense the 'Actual' flowrate and/or the 'Actual' pressure and/or other 'Actual' data associated with the wellbore fluid that is flowing inside the tubing of FIG. 19, and output signals 24A are generated from the sensors 24 representative of that 'Actual' data. Those output signals 24A are provided as 'input data' to the computer apparatus 30 which can be located at the surface of the wellbore In the meantime, the 'Eclipse simulator' 32 predicts the 'Target' flowrate and/or the 'Target' pressure and/or the 'Target' other data associated with the wellbore fluid which, it is predicted, will flow from the perforations 34 in FIG. 19, and output signals 38 are generated from the 'Eclipse simulator' 32 representative of that 'Target' data. Those output signals 38 are also provided as 'input data' to the computer apparatus 30 which can be located at the surface of the wellbore. Now, the computer apparatus 30 receives both: (1) the 'Actual' data 24A from the sensors 24, and (2) the 'Target' data 38 from the simulator 32. The computer apparatus 30 compares the 'Actual' data 24 with the 'Target' data 38. If the 'Actual' data 24 does not deviate significantly from the 'Target' data 38, the computer apparatus 30 will not change the 'predetermined signature' of the intelligent control pulses 18. However, assume that the 'Actual' data 24A does, in fact, deviate significantly from the 'Target' data 38. In that case, the computer apparatus 30 will execute the program code that is stored therein which is known as the 'Monitoring and Control Process', in accordance with one aspect of the present invention. When the 'Monitoring and Control Process' is executed by the computer apparatus 30, the 'predetermined signature' of the intelligent control pulses 18 is changed to another, different signature which is hereinafter known as 'another predetermined signature'. A new set of control pulses 18 is now generated which have a 'signature' that corresponds to said 'another predetermined signature'. That new set of control pulses 18 are transmitted downhole, and, as a result, the valve 12A of the ICV 12 opens and/or closes in a 'another predetermined manner' which is different than the previously described 'predetermined manner'; for example, the valve 12A may now open and close at a rate which is different than the previous rate of opening and closing. As a result, the wellbore fluid being produced from the perforations 34 will now be flowing through the valve 12A and uphole to the surface at a flowrate and/or pressure which is now different than the previous flowrate and/or pressure of the wellbore fluid flowing uphole. The sensor 24 will sense that flowrate and/or pressure, and new 'Actual' signals 24A will be generated by the sensor 24. Those new 'Actual' signals will be compared, in the computer apparatus 30, with the 'Target' signals from the simulator 32, and, if the 'Actual signals' are significantly different than the 'Target' signals, the 'Monitoring and control Process' will be executed once again, and, as a result, the signature of the control pulses 18 will be changed again and a third new set of control pulses 18 will be transmitted downhole. The aforementioned process and procedure will be repeated until the 'Actual' signals 24A are not significantly different than the 'Target' signals 38. If the 'Actual' signals 24A remain significantly different than the 'Target' signals 38, the 'Eclipse simulator' 32 will adjust the 'Target' signals 38 to a new value, and the above referenced process will repeat itself once again until the 'Actual' signals 24A are approximately equal to (i.e., are not significantly different than) the 'Target' signals 38.

In the above discussion, we have been discussing one valve in one well and the pulse to control the one valve in the one well. One of ordinary skill in the art would realize that the above discussion could extend to either multiple valves in a single well or multiple valves in multiple wells. In addition, instead of controlling an Intelligent Control Valve (ICV), one could use the above method in the above discussion to control an active downhole fluid lift method, such as: (1) an Electro-Submersible Pump or ESP, (2) gas lift, (3) a Beam pump, (4) a Progressive Cavity Pump, (5) a Jet Pump, and (6) a downhole separator.

Figure 12:
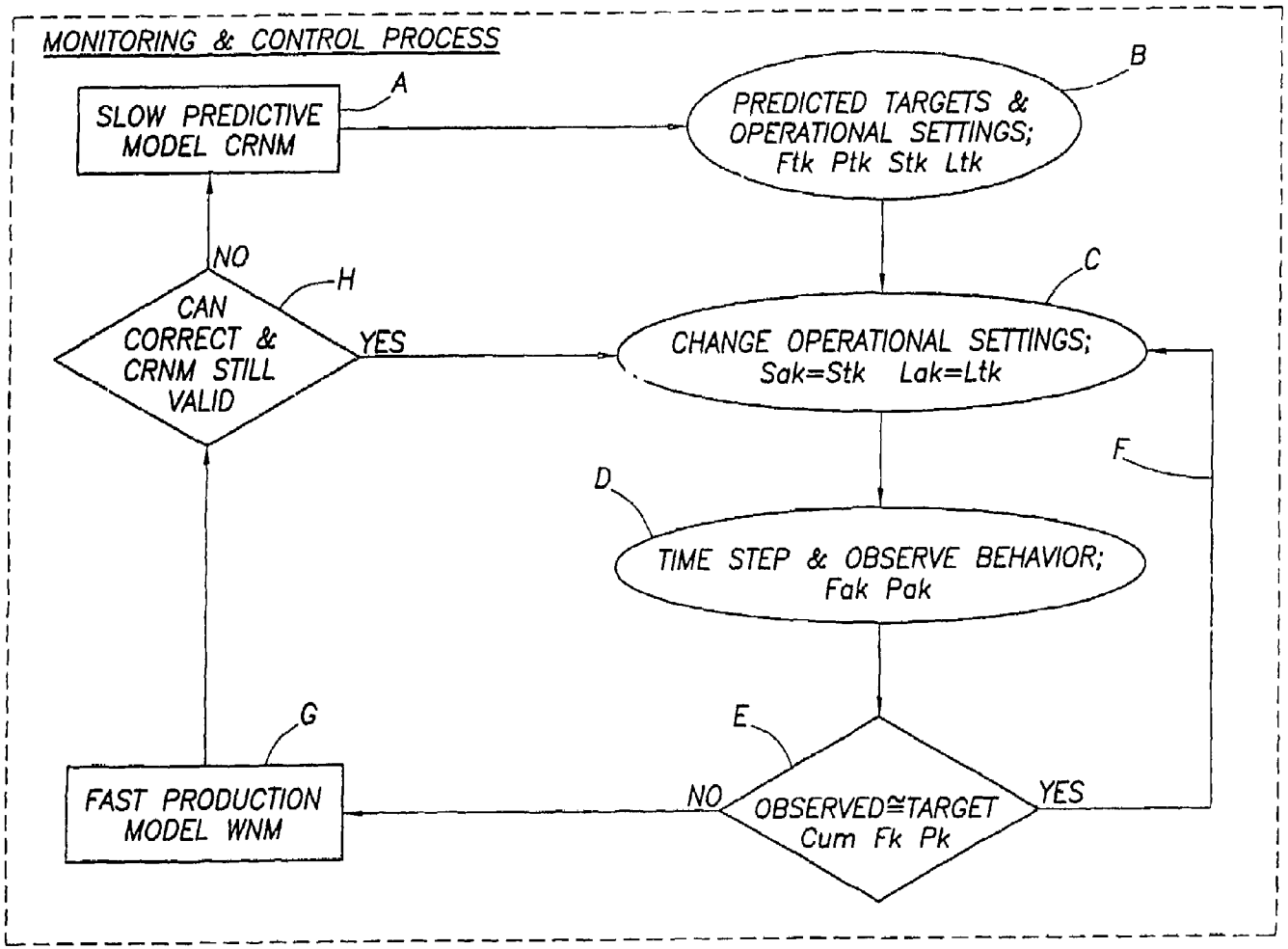
FIG. 12 illustrates the monitoring and control process in accordance with the present invention.
Figure 13:
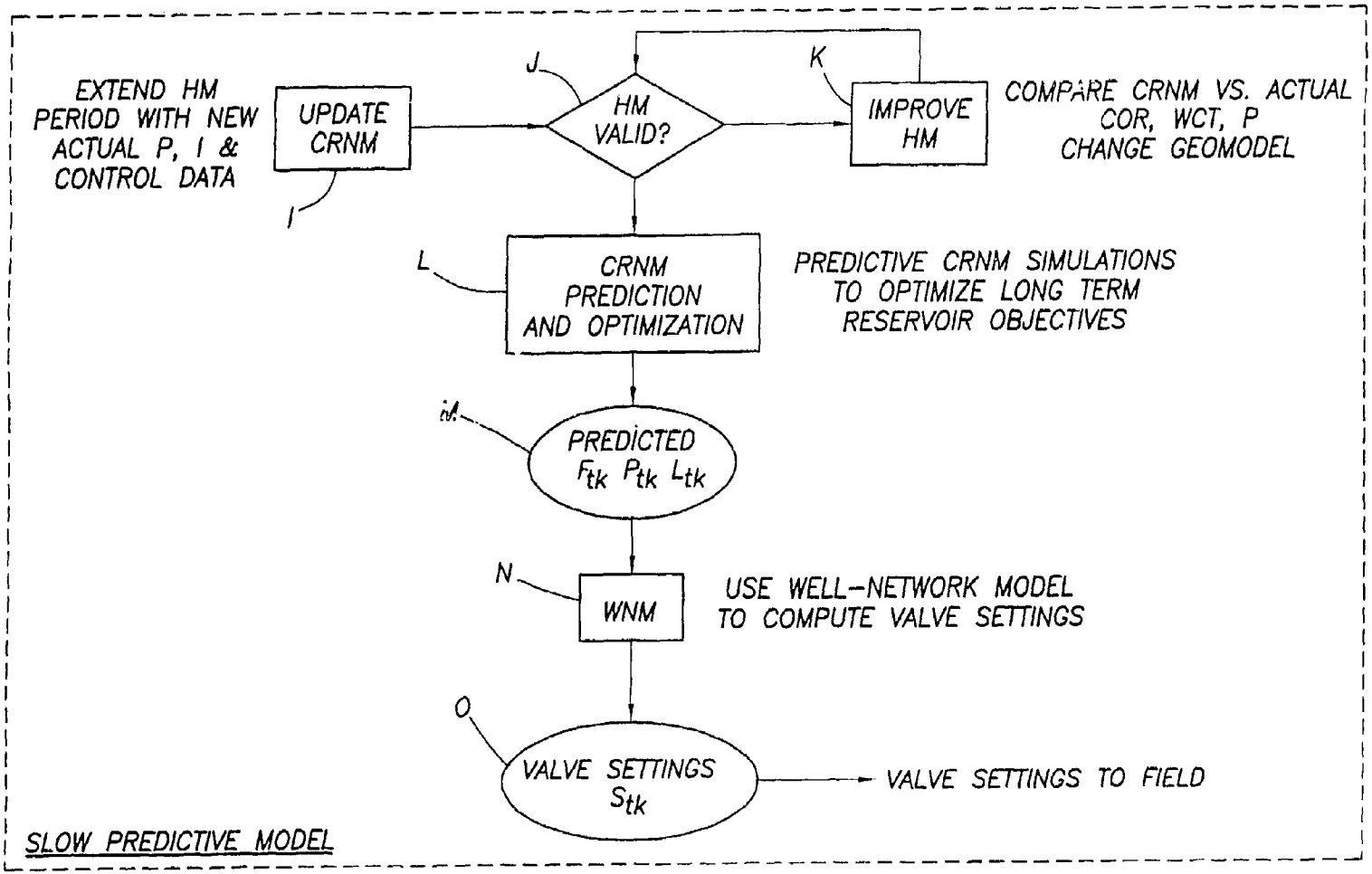
FIG. 13 illustrates the slow predictive model portion of the monitoring and control process of FIG. 12.
Figure 14:
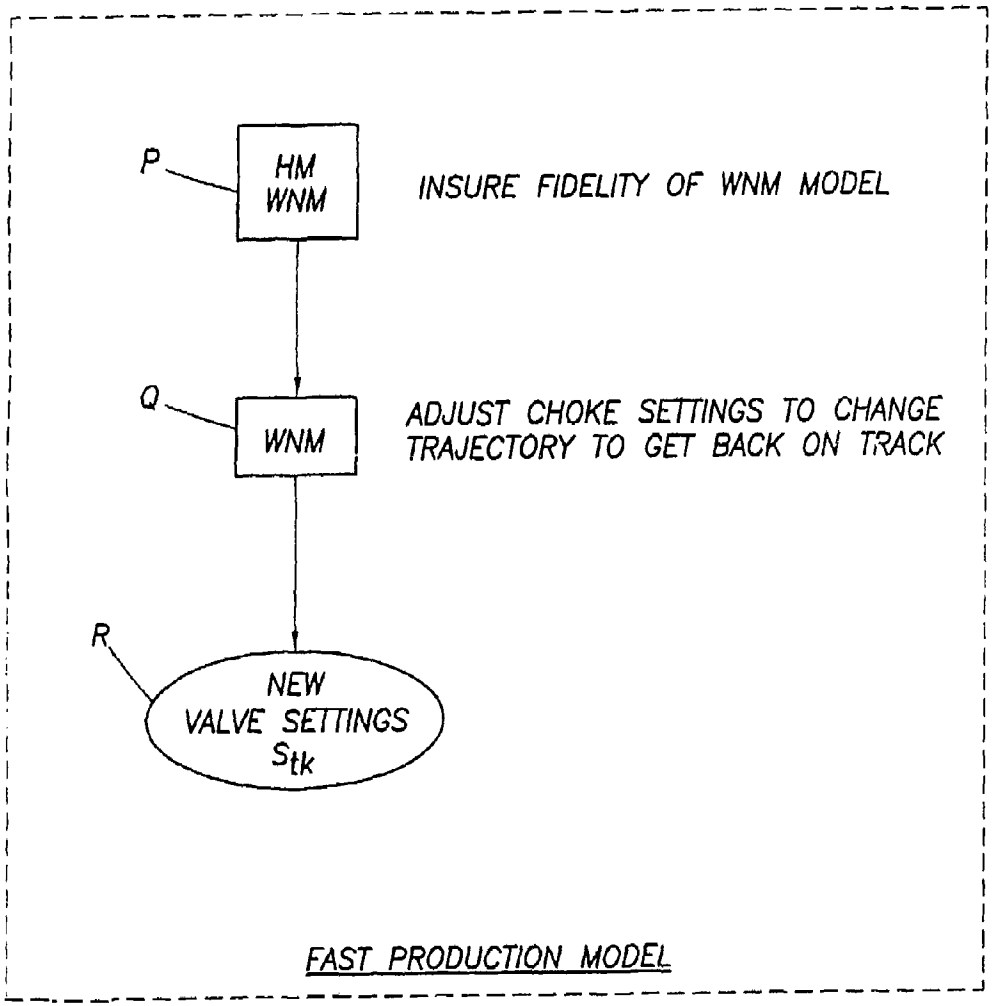
FIG. 14 illustrates the fast production model portion of the monitoring and control process of FIG. 1.

A detailed construction of the "monitoring and control process" 30A of FIGS. 18 and 19 in accordance with the present invention is set forth below with reference to FIGS. 1 through 14 of the drawings. A workflow or flowchart of the "monitoring and control process" 30A is illustrated in FIGS. 12, 13, and 14.

Referring to FIGS. 1 through 14, the 'monitoring and control' process of the present invention is illustrated. We begin this discussion with a simple example to illustrate the phenomenon, with reference to FIGS. 1 through 11, before explaining the workflow of FIGS. 12, 13, and 14.

Figure 1:
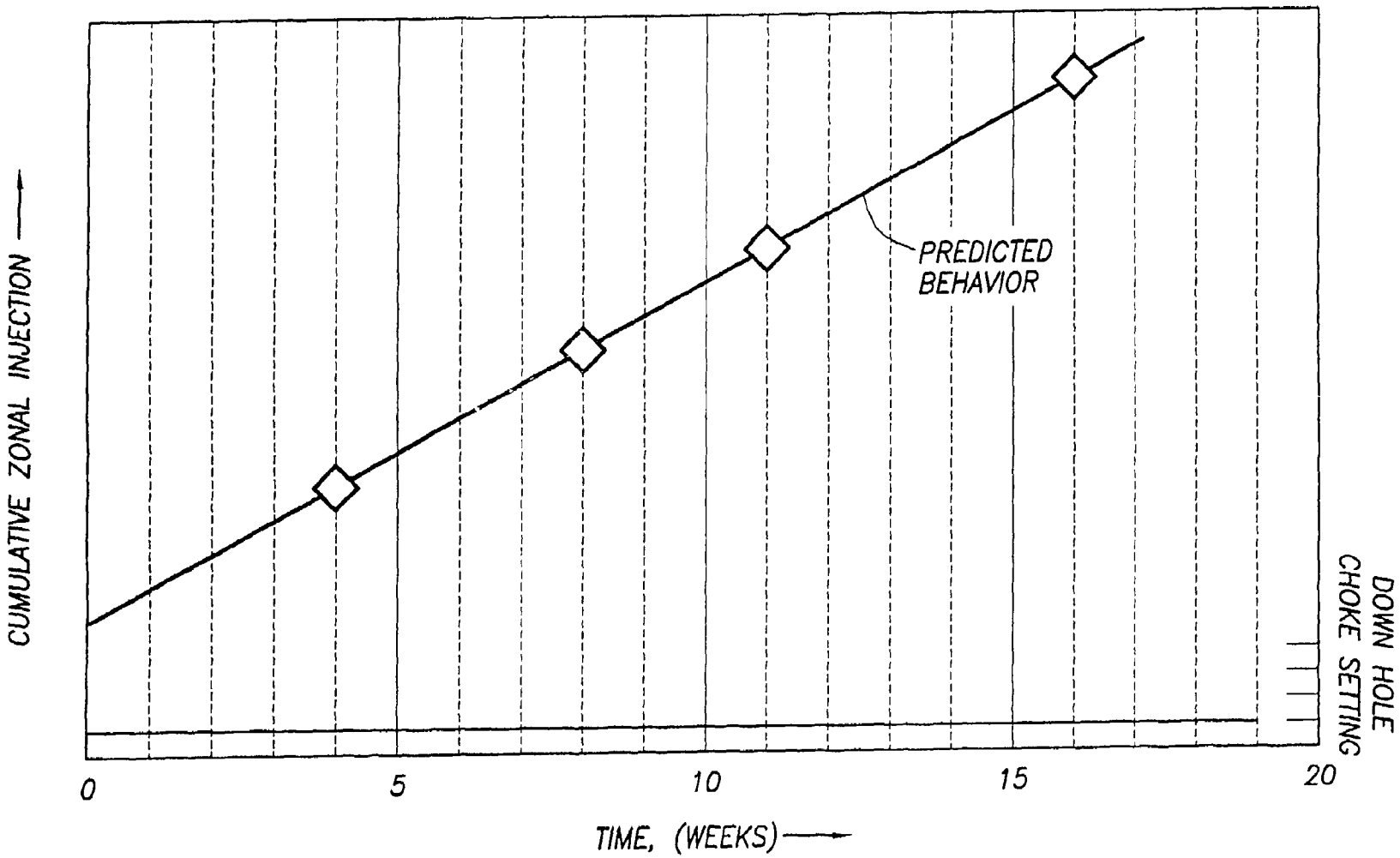
FIGS. 1 through 11 illustrate curves depicting cumulate zonal injection versus time (in weeks)

Consider the case of a single oil reservoir layer. The reservoir is intersected by a well with an ICV placed in the layer (see reference 1 below). The valve allows the rate of fluid movement between the reservoir and the interior of the well to be changed by changing the valve position. Consider that the well is used to inject water into the oil layer to help push the oil toward another well that is producing the oil from the reservoir layer. Further, suppose that as a result of previous predictions or numerical modeling of the reservoir and well, it has been determined that the ideal way to inject water into the layer is at a low constant rate. At a constant rate, the cumulative or running total of water is a straight line increasing function of time, as illustrated in FIG. 1. At the bottom of FIG. 1, it is indicated that the downhole choke (ICV) is positioned in the first of 4 possible opening positions. The straight line cumulative trend is called the target, since it is the optimum rate and it is desired to maintain the water injection as close as possible to this line.

Figure 2:
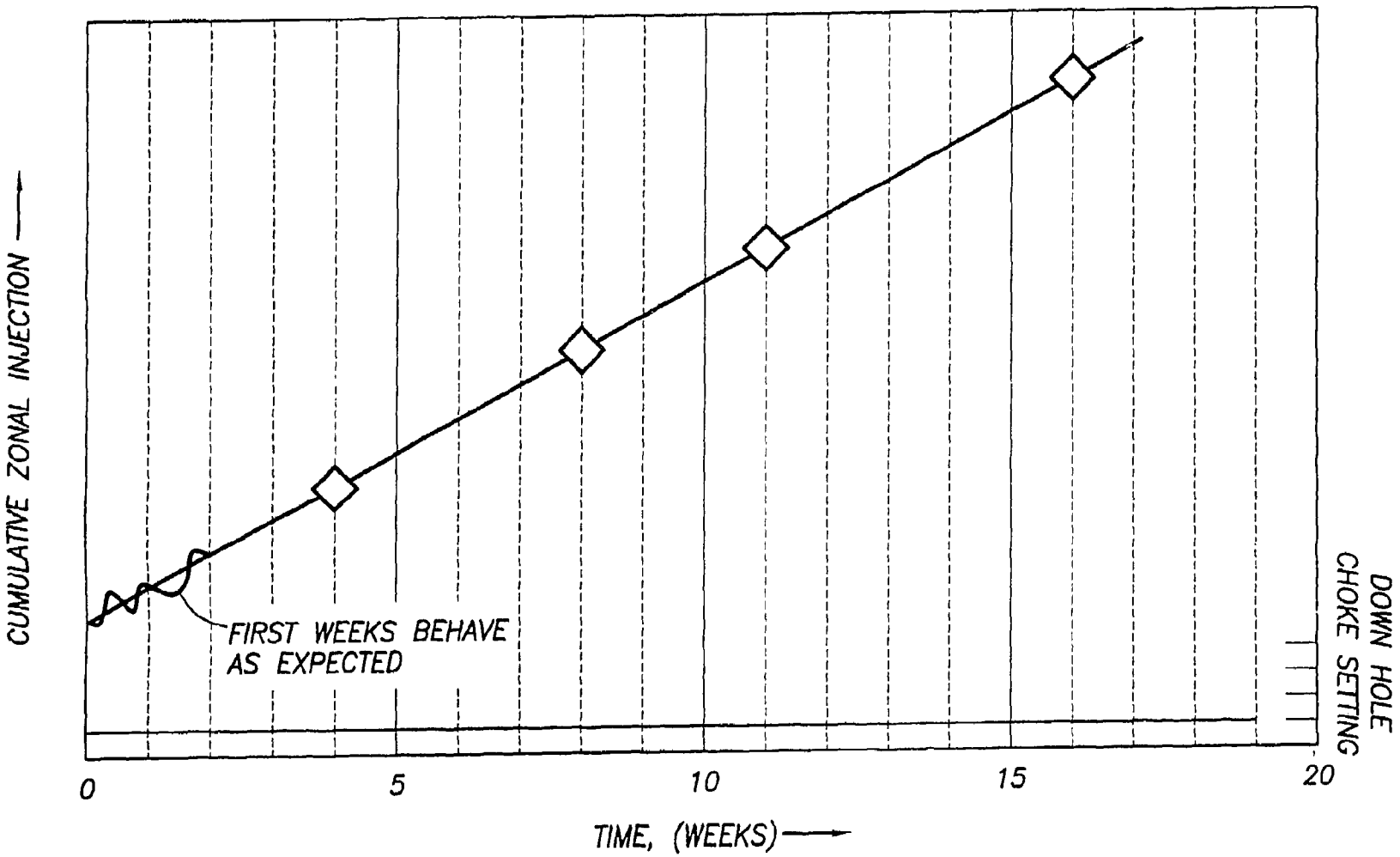

Suppose the reservoir begins production, and during the start-up time, water is injected into the well as planned. FIG. 2 illustrates the situation after 2 weeks. The actual cumulative injection is a wiggling line hovering around the target, meaning that the process of injecting water into the layer is proceeding without problem.

Figure 3:
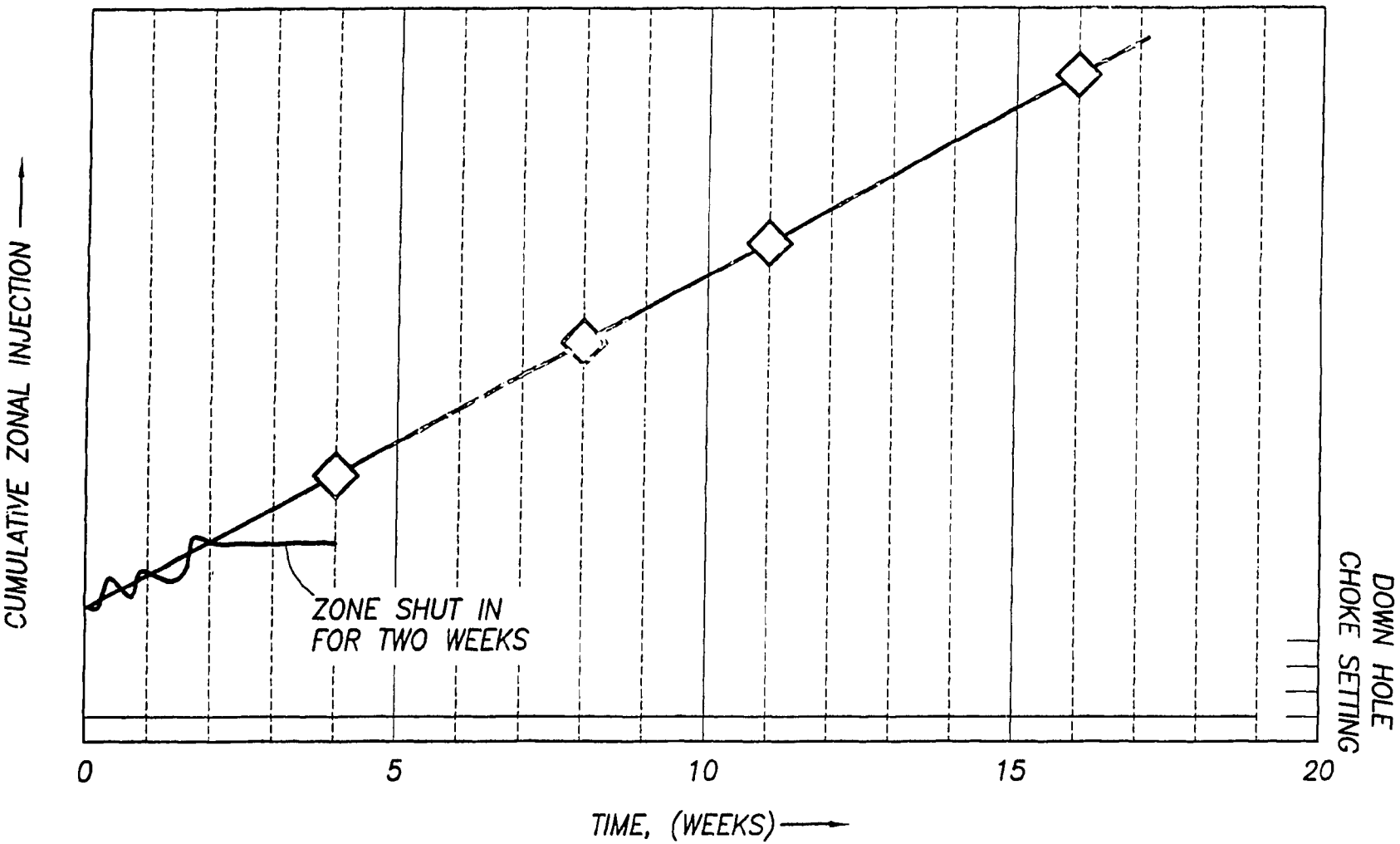

FIG. 3 shows the situation after 4 weeks. Now, perhaps because the source of injected water failed, the rate of injection has dropped to zero and the cumulative injection curve levels of to have zero slope. Now, the actual cumulative injected volume is well below the desired target value.

Figure 4:
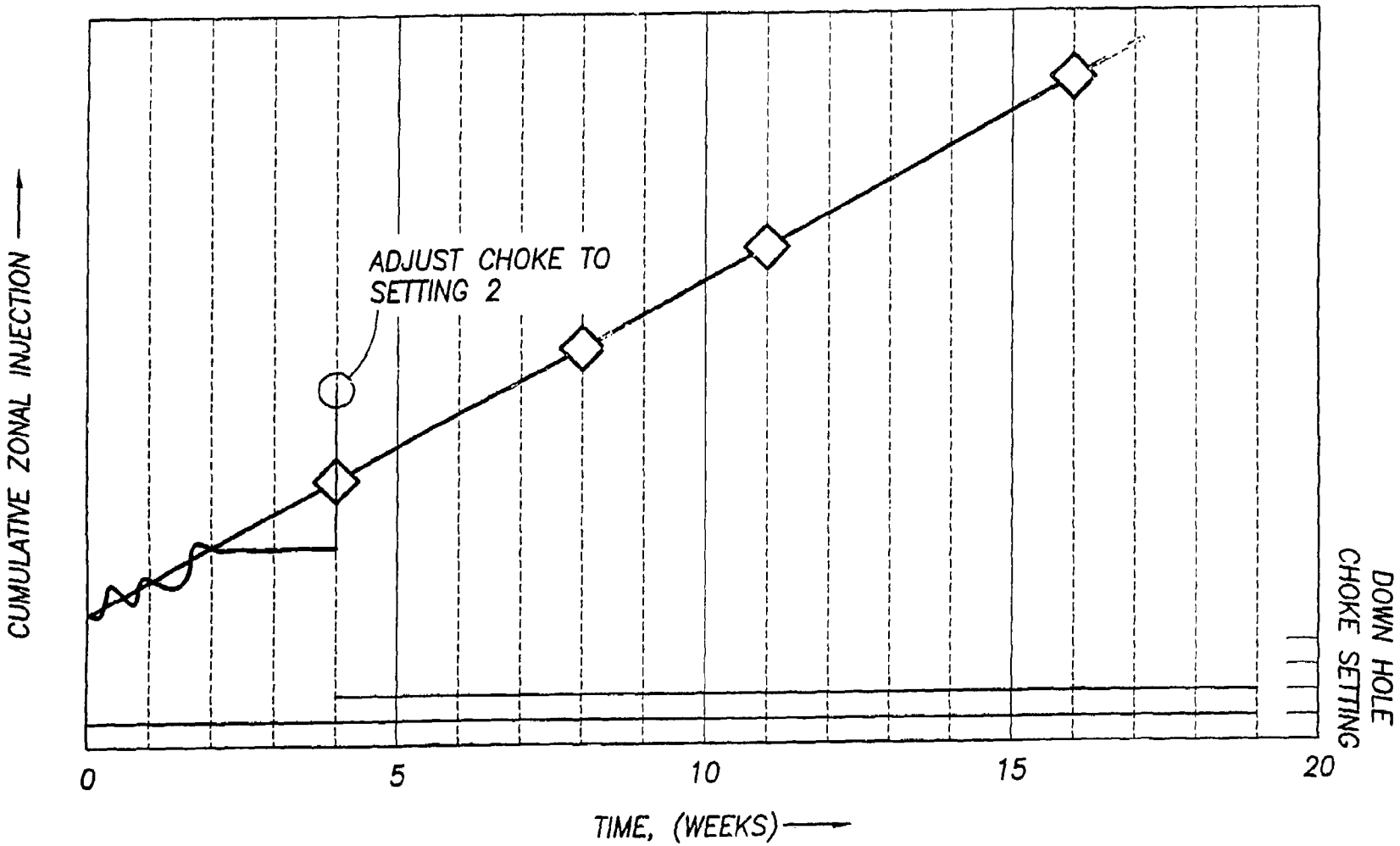
Figure 5:
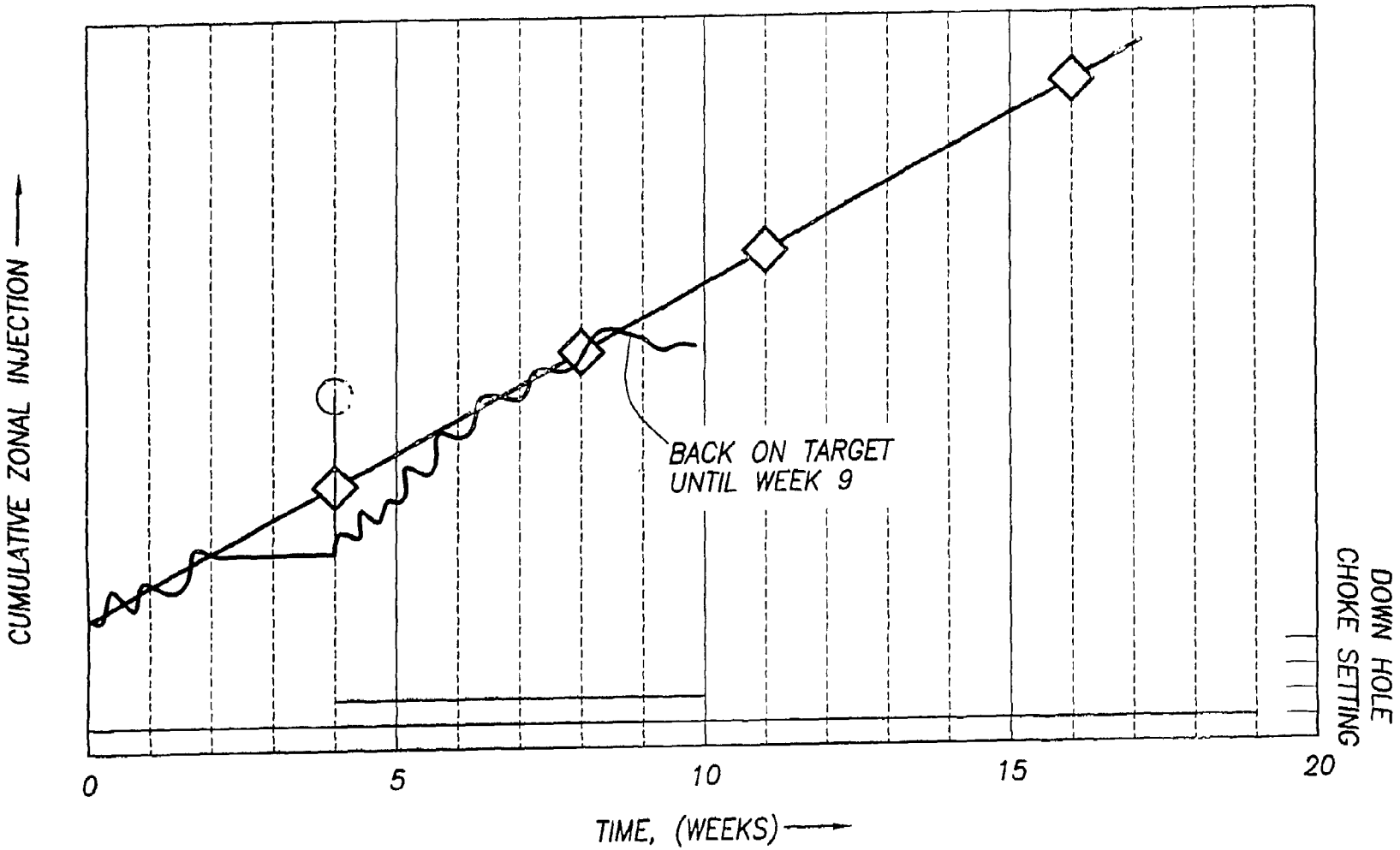

In FIG. 4, the result is shown of evaluating what would happen if the downhole choke (ICV) is moved to position 2. The circle shows that opening the valve would move production in the upward direction. It is therefore decided to open the ICV and continue production, as illustrated in FIG. 5.

Figure 6:
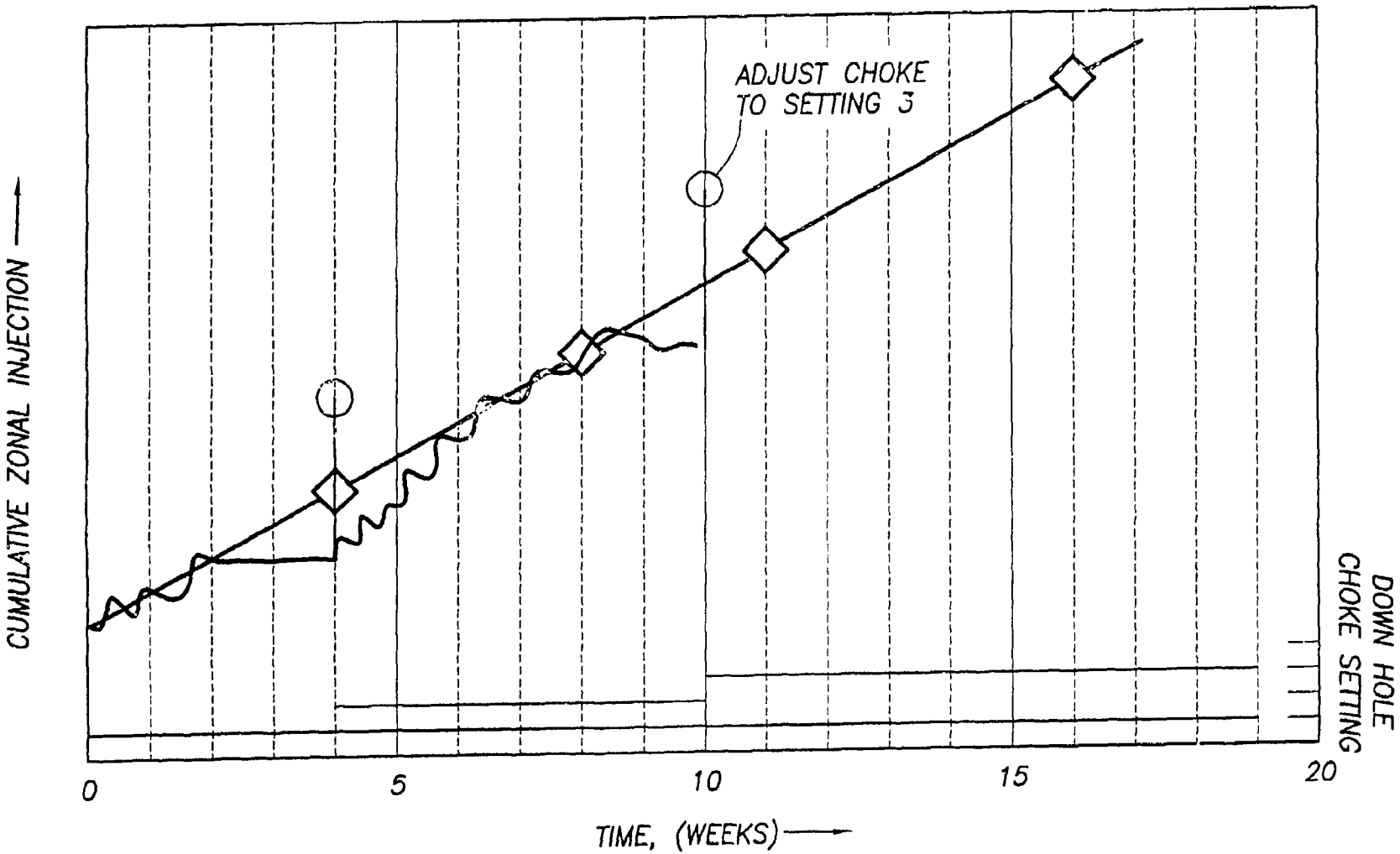

Now, after 10 weeks of injection, the actual cumulative injection has followed the target, but again is drifting below the target value. In FIG. 6, as in FIG. 4, the situation is evaluated to see what would happen if the ICV were once again opened one position to position 3. This would move the cumulative production in the positive (upward) direction, so this is decided.

Figure 7:
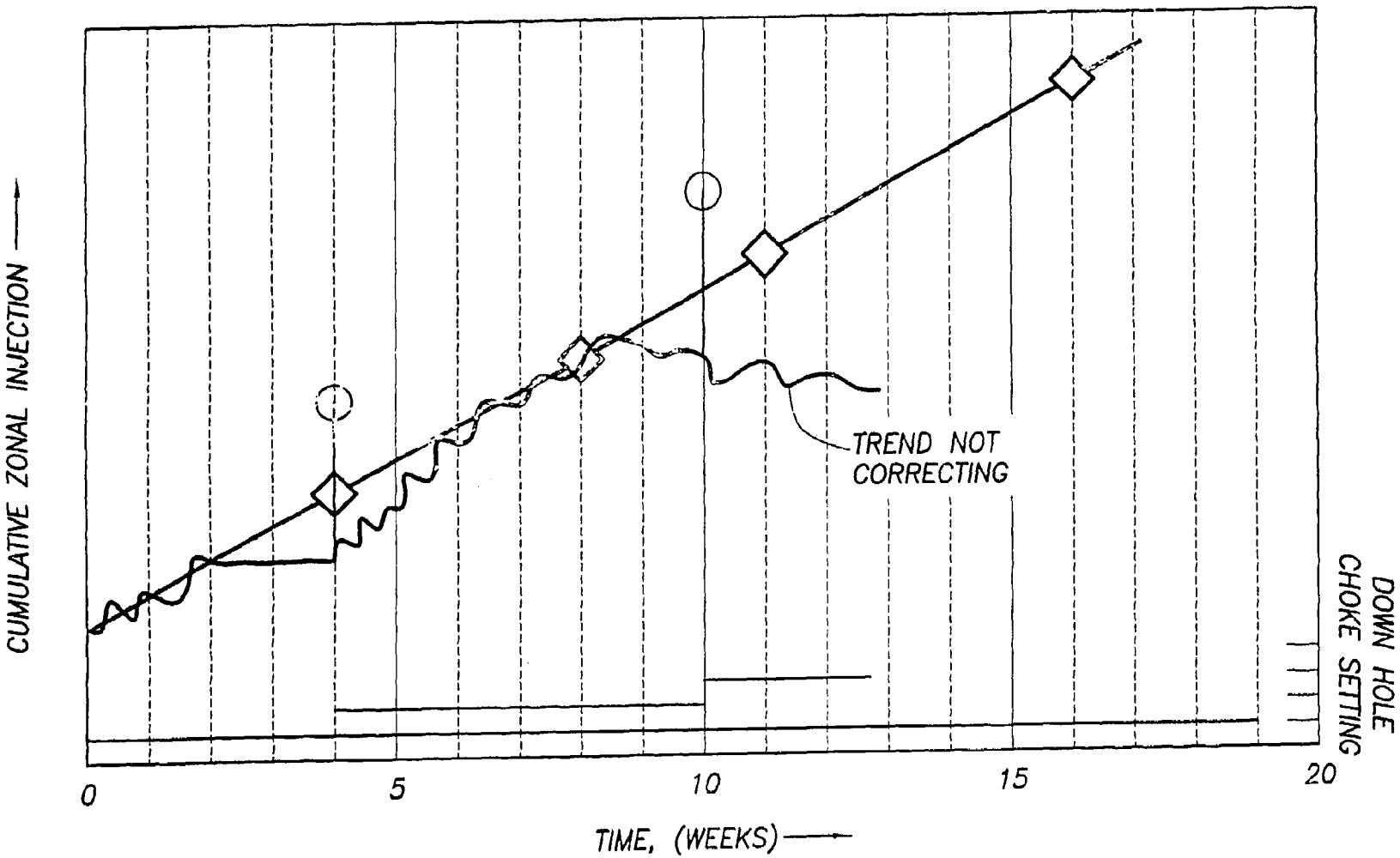
Figure 8:
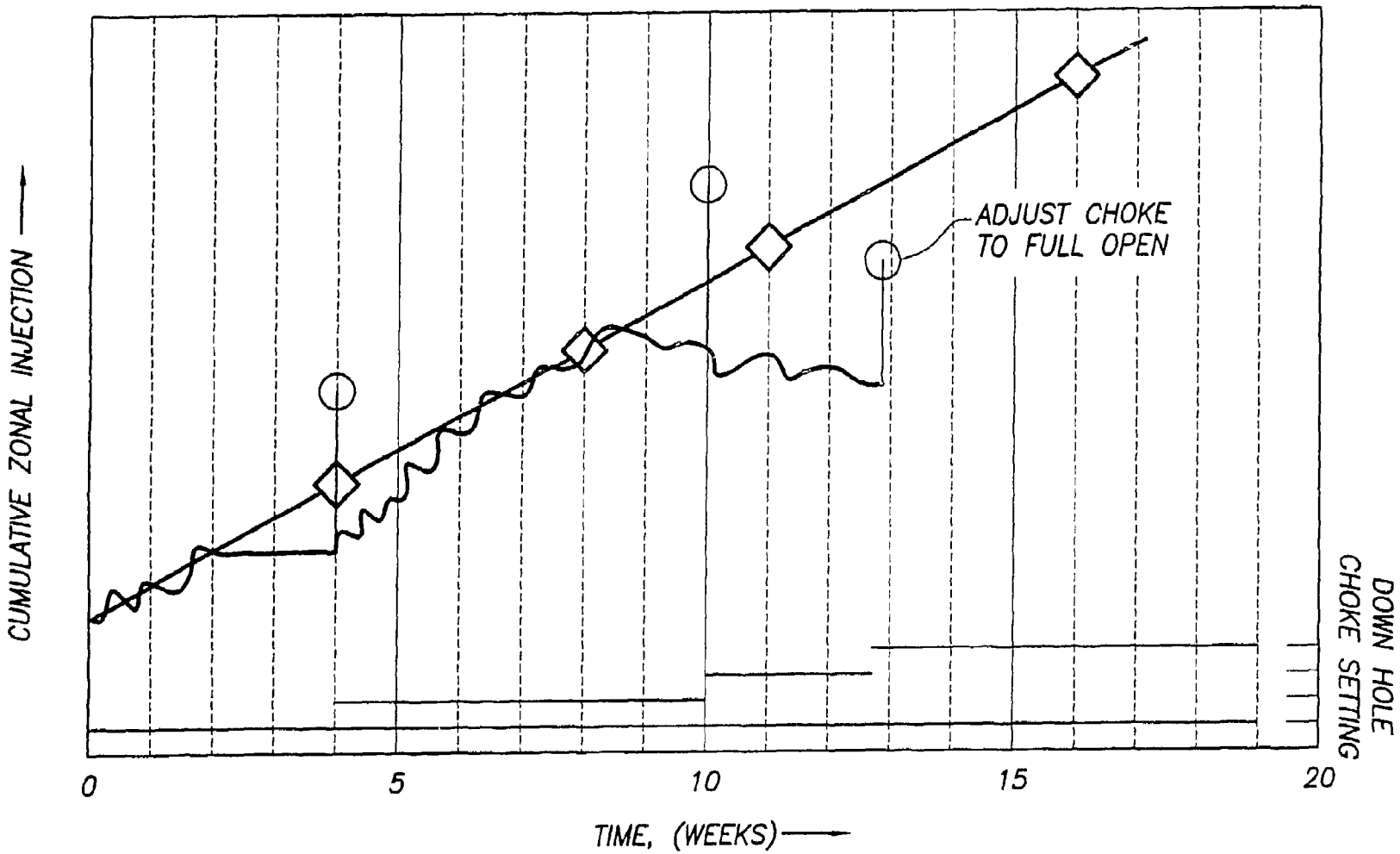
Figure 9:
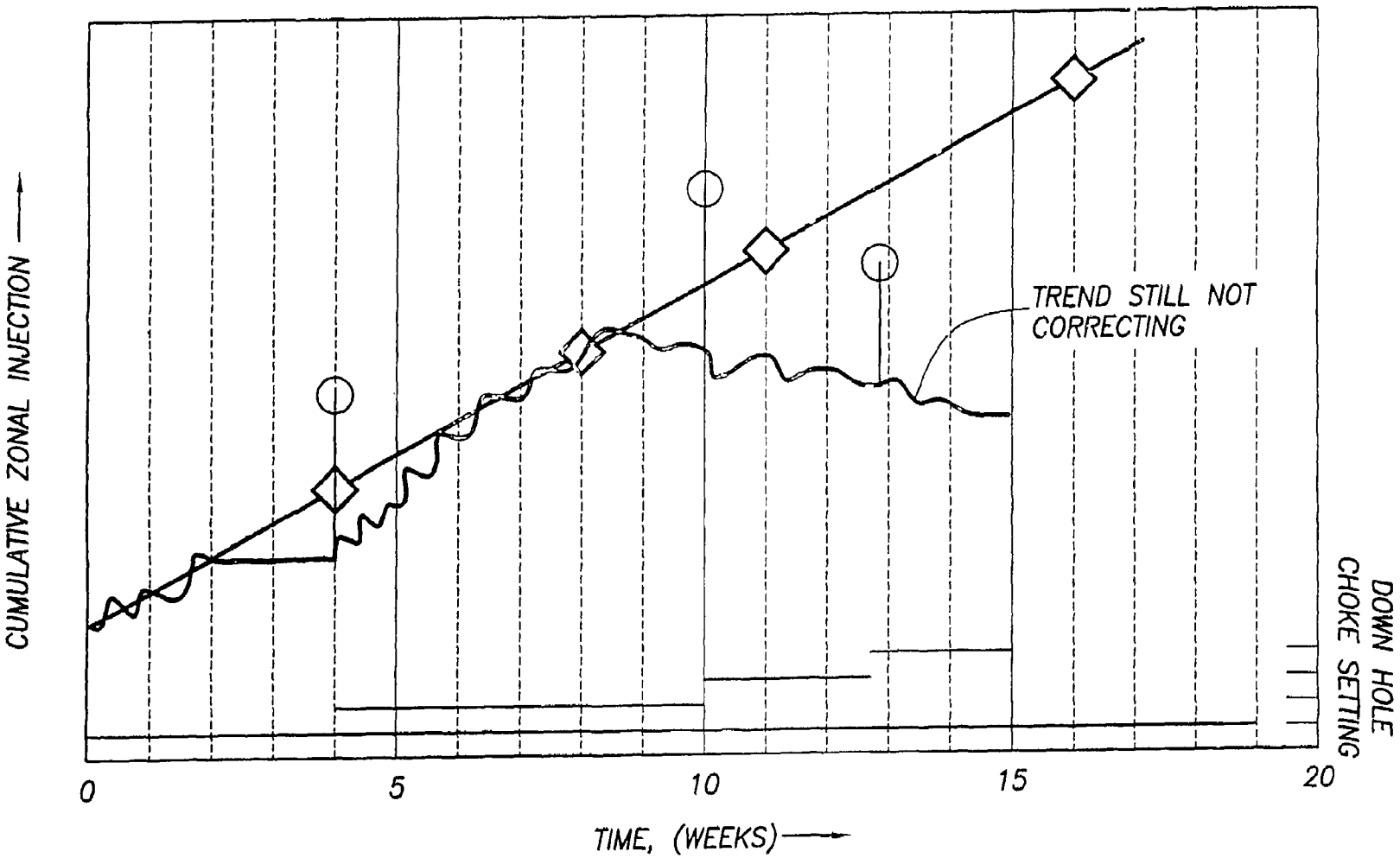

FIG. 7 shows the result of continuing production with the ICV in position 3 out of 4. Now, unfortunately, the cumulative volume is not increasing near the target. Further, as shown in FIG. 8, evaluating what would happen if the valve were opened to the last position number 4, it is seen that the correction is insufficient to return the cumulative injection to the target. Sure enough, as shown in FIG. 9, after 15 weeks, the discrepancy between the actual and target curves is unacceptably large.

Figure 10:
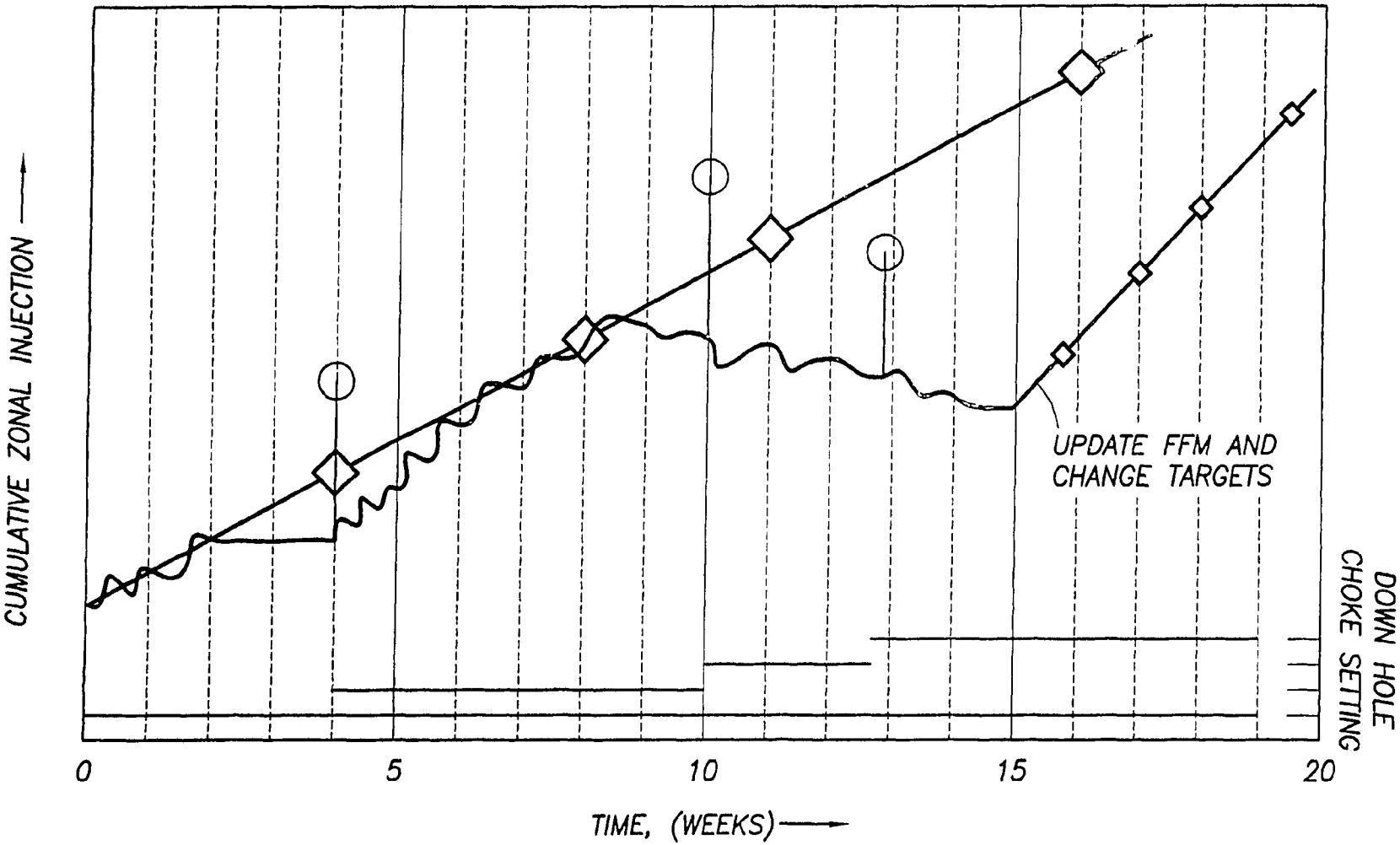

FIG. 10 shows that at this time, it is necessary to re-evaluate the overall behavior of the numerical model of the reservoir, and a new target (starting at week 15) is determined, assuming that the valve stays in position 4.

Figure 11:
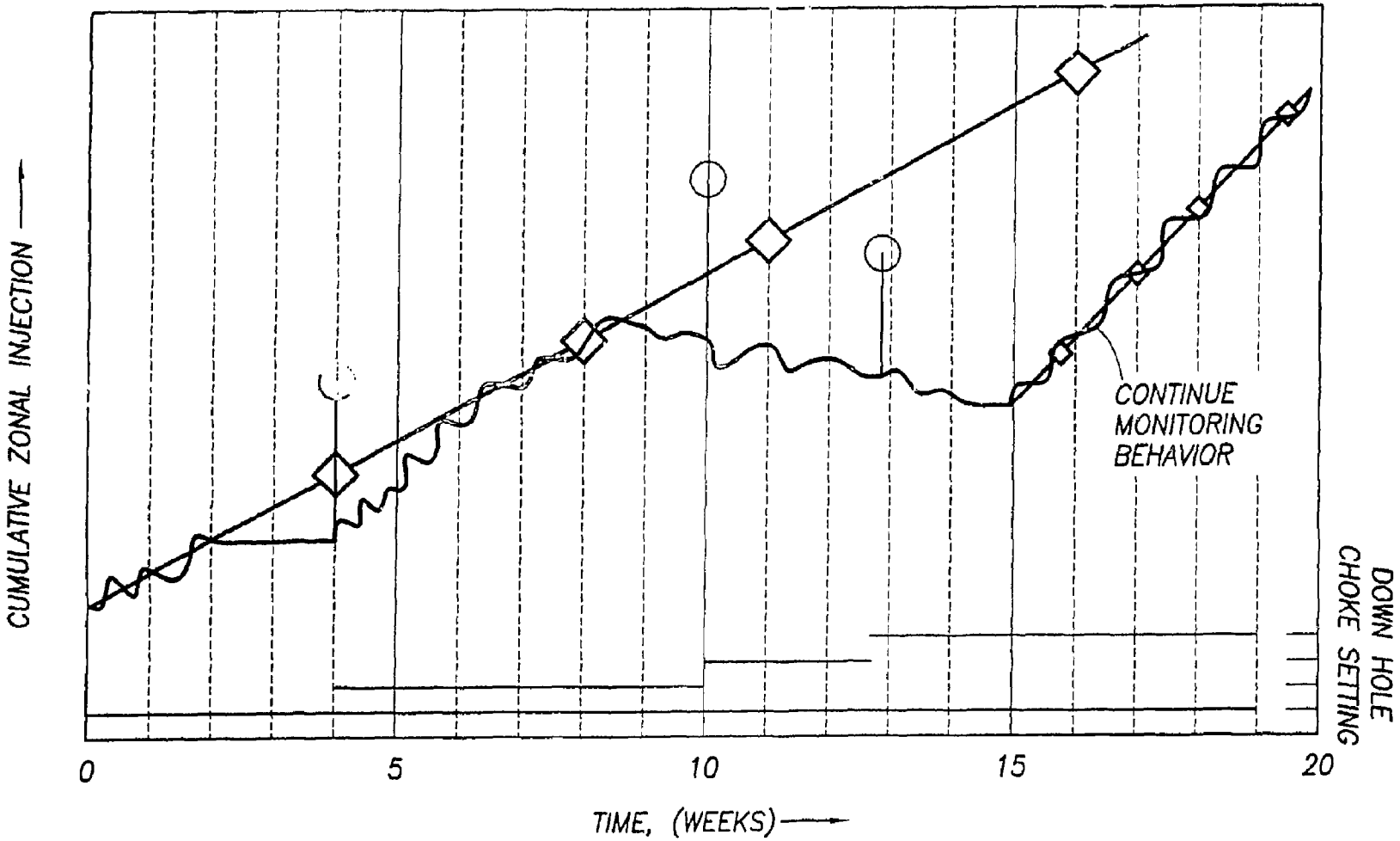

FIG. 11 shows that continuing at the new injection rate, the actual and target curves overlay, and the process is proceeding without problem.

The simple example just shown illustrates an approach toward adjusting downhole control valves based on frequent (e.g. hour-day) monitoring data such as the downhole pressure or the flow rate into an oil or gas reservoir layer.

FIGS. 12-14 show a series of three workflow diagrams. FIG. 12 is the high level summary of the workflow. FIG. 12 contains a slow and fast loop, each of the slow loop and the fast loop being shown in greater detail in FIGS. 13 and 14, respectively.

What follows is a description of these detailed workflows.

Field Optimization Workflow

FIG. 12 illustrates a high-level workflow; the individual activites or tasks are numbered and keyed to the text below. This workflow contains slow and fast loops (described in Appendices 2 and 3 below) that interact at a high level as shown In the slow loop, reservoir-network simulation is used to define the optimal future development of the field. The fast loop translates the results of the slow loop into day-to-day operational controls of the field, e.g. ICV settings, etc. Overall, the workflow is expected to comprise the following series of modeling and planning activities:

Slow loop—A coupled reservoir-network model (CRNM) A is used to predict optimal future target pressures $P_{tk}$ and target multiphase flow rates $F_{tk}$ B for wells and zones at time step k. FIG. 1 shows a simple example of an output of this process, specifically, a target zonal injection rate over a period of 17 weeks, computed using a simulator. The CRNM also predicts the future network line assignments $L_{tk}$. Line assignments are the matching of individual wells in a group to one of two subsea production lines. Then, based on CRNM target information $P_{tk}$ and $F_{tk}$, a well-network model (WNM) is used to predict the optimal future target downhole valve settings $S_{tk}$. For the initial time step, the CRNM is defined through a characterization process based on available reservoir, geologic and well data.

The valve settings and line assignments $S_{tk}$ and $L_{tk}$ are sent to the field and they become the actual settings $S_{ak}$ and $L_{ak}$, C.

The field is produced for a period of time (e.g. several days). During this interval, real-time data are measured, e.g. surface and downhole pressures $P_{ak}$, multiphase fluid rates $F_{ak}$, etc, D. The measured flow rate data are allocated back to wells and zones, as appropriate.

The observed and targeted cumulative multiphase flow rates are compared E. FIGS. 2-12 illustrate the comparison of the targeted (straight line) and observed (squiggle line) cumulative zonal injection rates for the above example. Additionally, the observed and targeted pressures are compared.

If the discrepancies between the observed and target values are within some specified tolerance, the model is correctly predicting field performance. No corrective action is required and field production continues for another time step F. FIG. 2 is an example with no significant discrepancy observed.

The observed discrepancies may be large. Continuing with the simple example, FIG. 3, shows the observed zonal injection rate up to week 4 where the injector rate has dropped to zero during a period of 2 weeks. In the case of a significant discrepancy, the process enters the Fast Production model G.

The fast loop computes new valve and line assignments to reduce the discrepancies and return the field pressures and rates closer to the targets. FIG. 4 illustrates a new target trajectory (small circle) to return the cumulative injected zonal volume to the initial target.

If the fast loop is unable to determine new valve and line assignments that reduce the discrepancies H, or the trends in the discrepancies suggest that the CRNM is no longer valid, the process returns to the slow loop in #1 to develop new predictive targets.

Slow Loop Workflow

FIG. 13 illustrates the slow loop workflow. Overall, the slow loop workflow, carried out only when required, is expected to comprise the following series of modeling and planning activities:

At time step k, update (I) the CRNM by extending the history match period using the available multiphase well and zonal flow rates $F_{ak}$, and accounting for any network changes since the last model update: $S_{ak}$ and $L_{ak}$.

Check that the history match model is valid J, by comparing the actual measured data against the data predicted from the CRNM, e.g. gas-oil ratios, watercuts, pressures, etc versus time. If the model is not valid to within a specified tolerance, update the history match model K by modifying the underlying geomodel.

Once the CRNM is sufficiently history-matched, run CRNM predictive modeling L to determine new optimal trajectories for pressures $P_{tk}$, multiphase well and zonal rates $F_{tk}$, etc Mi. The CRNM captures the reservoir, well, line, and network effects, and computes the optimal line assignments $L_{tk}$. The CRNM does model the downhole wellbore, but does not explicitly model the downhole flow control valve settings. Because the CRNM time step size is typically much larger than the interval between adjustments to the production system, the CRNM only produces general trends in the pressure drops across the valves needed to obtain the optimal target rates.

Based on the predicted CRNM results $P_{tk}$ and $F_{tk}$, run the WNM N to determine the downhole valve settings $S_{tk}$ O that yield differential pressures which most closely match the predicted differential pressures.

Fast Loop Workflow

The fast loop workflow, illustrated in FIG. 14, will be carried out on a day-to-week time scale, and is expected to comprise the following series of activities:

At time step k, history match the WNM P with the actual multiphase well and zonal flow rates $F_{ak}$ and pressures $P_{ak}$, accounting for the actual line assignments $L_{ak}$ and valve settings $S_{ak}$. History matching is carried out by tuning the multiphase flow correlations.

Discrepancies between the actual and predicted rates and pressures are reviewed. Returning to the earlier example, FIG. 7 illustrates the predicted and actual zonal injection cumulative volumes, where a large discrepancy has developed between week 8 and week 13 as a result of loss of injection. Note that discrepancies may be due to planned or unplanned outages, and planned outages may be anticipated and production settings optimized proactively. In the case of large discrepancy, it is necessary to restore the pressure and cumulative rate trends back to the optimally predicted trajectories. Changes in target rates $F_{tk}$ are identified to achieve a smooth return to the predicted trends. A smooth return may require minor modifications spread over several time steps.

Using the history matched WNM from step #1, and the adjusted rates $F_{tk}$ from step #2, compute Q the set of valve settings $S_{tk}R$ for the next time step to attain the rates

REFERENCES

The following references are incorporated by reference into this specification:

1 Algeroy, J. et. al., "Controlling Reservoirs from Afar", *The Oilfield Review* (1999), 11 (3), pp. 18-29.

2 Baker, A., et. al., "Permanent Monitoring—Looking at Lifetime Reservoir Dynamics", *The Oilfield Review*, (1995), 7 (4), pp. 32-46.

3 Beamer, A., et. al., "From Pore to Pipeline, Field-Scale Solutions", *The Oilfield Review* (1998), 10 (2) pp. 2-19.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for continuously optimizing reservoir well and surface network systems, comprising the steps of:

(a) transmitting an input stimulus having a predetermined signature downhole into a wellbore and controlling in a predetermined manner in response to the predetermined signature a downhole apparatus adapted to be disposed in said wellbore;

(b) continuously monitoring an actual characteristic of a wellbore fluid flowing in a tubing of said downhole apparatus in response to the transmitting step and generating actual signals representative of said actual characteristic of said wellbore fluid;

(c) predicting a target characteristic of said wellbore fluid flowing in said tubing and generating target signals representative of said target characteristic of said wellbore fluid;

(d) comparing said actual signals with said target signals and executing a monitoring and control process when said actual signals are not approximately equal to said target signals:

(e) changing the predetermined signature of said input stimulus in response to the executing step thereby generating a second input stimulus having a second predetermined signature; and (f) repeating steps (a) through (e), using said second input stimulus, and continuously changing the predetermined signature of the input stimulus until said actual signals are approximately equal to said target signals; and (g) generating a second target signal representative of said target characteristic of said wellbore fluid when, after the repeating step (f), said actual signals are not approximately equal to said target signals.

2. An apparatus adapted for continuously optimizing reservoir well and surface network systems, comprising:

first means for transmitting an input stimulus having a predetermined signature downhole into a wellbore and controlling in a predetermined manner in response to the predetermined signature a downhole apparatus adapted to be disposed in said wellbore;

second means for continuously monitoring an actual characteristic of a wellbore fluid flowing in a tubing of said downhole apparatus in response to the transmitting of said first means and generating actual signals representative of said actual characteristic of said wellbore fluid;

third means for predicting a target characteristic of said wellbore fluid flowing in said tubing and generating target signals representative of said target characteristic of said wellbore fluid;

fourth means for comparing said actual signals with said target signals and executing a monitoring and control process when said actual signals are not approximately equal to said target signals, said fourth means changing the predetermined signature of said input stimulus when the execution of said monitoring and control process is complete and generating a second input stimulus having a second predetermined signature, said first means for transmitting said second input stimulus having said second predetermined signature downhole into a wellbore and controlling said downhole apparatus, said second means continuously monitoring said actual characteristic of said wellbore fluid flowing in a tubing and generating further actual signals representative of said actual characteristic of said wellbore fluid, said third means generating said target signals representative of said target characteristic of said wellbore fluid, and said fourth means comparing said further actual signals with said target signals and continuously re-executing said monitoring and control process until said actual signals are approximately equal to said target signals, wherein said third means generates further target signals representative of said target characteristic of said wellbore fluid when said actual signals are not approximately equal to said target signals, said fourth means comparing said further actual signals with said further target signals and continuously re-executing said monitoring and control process until said further actual signals are approximately equal to said further target signals.

* * * * *